US005462429A

United States Patent [19]

Pritchard et al.

[11] Patent Number: 5,462,429

[45] Date of Patent: Oct. 31, 1995

[54] MECHANICAL WIPER FOR WASTE GAS INCINERATOR

[75] Inventors: Francis E. Pritchard, Buffalo, N.Y.; Eugene H. Koederitz, Westfield, N.J.; Ronald E. Fuhrhop, Orchard Park, N.Y.; Thomas H. Barker, Jr., Kingman, Ariz.

[73] Assignee: Praxair Technology, Inc., Danbury, Conn.

[21] Appl. No.: 138,284

[22] Filed: Oct. 20, 1993

[51] Int. Cl.[6] ..... F23J 1/06; F23D 17/00

[52] U.S. Cl. ..... 431/3; 431/5; 431/121; 431/122; 110/343; 126/173; 165/94; 165/95

[58] Field of Search ..... 431/3, 5, 121, 431/122; 165/94, 123, 95; 110/343; 126/173

[56] References Cited

U.S. PATENT DOCUMENTS

| | | | |
|---|---|---|---|
| 1,486,685 | 3/1924 | Reinhardt | 431/122 |
| 1,874,781 | 8/1932 | McKesson | 431/122 |
| 2,755,850 | 7/1956 | Cissell | 431/122 |
| 3,730,486 | 5/1973 | Hayashi et al. | 165/94 |
| 4,059,712 | 11/1977 | Bothwell | 428/36 |
| 4,095,307 | 6/1978 | Brubaker | 165/94 X |
| 4,276,331 | 6/1981 | Bothwell | 428/36 |
| 4,291,753 | 9/1981 | Fisher et al. | 165/94 |
| 4,376,374 | 3/1983 | Bothewell | 60/687 |
| 5,123,836 | 6/1992 | Yoneda et al. | 431/5 |
| 5,265,671 | 11/1993 | Vowles | 165/95 |

OTHER PUBLICATIONS

Guardian®–Semiconductor Safety Technology–Hoechst Celanese–Mar. 15, 1991.

Guardian® EZ–Clean Flange–Semiconductor Safety Technology–Hoechst Celanese.

*Primary Examiner*—Larry Jones

*Attorney, Agent, or Firm*—Cornelius F. O'Brien

[57] ABSTRACT

A mechanical wiper mounted within an incinerator for waste gases, such as silane, and said wiper adapted to move adjacent selected internal surface areas to remove combustion products buildup on such selected areas.

15 Claims, 1 Drawing Sheet

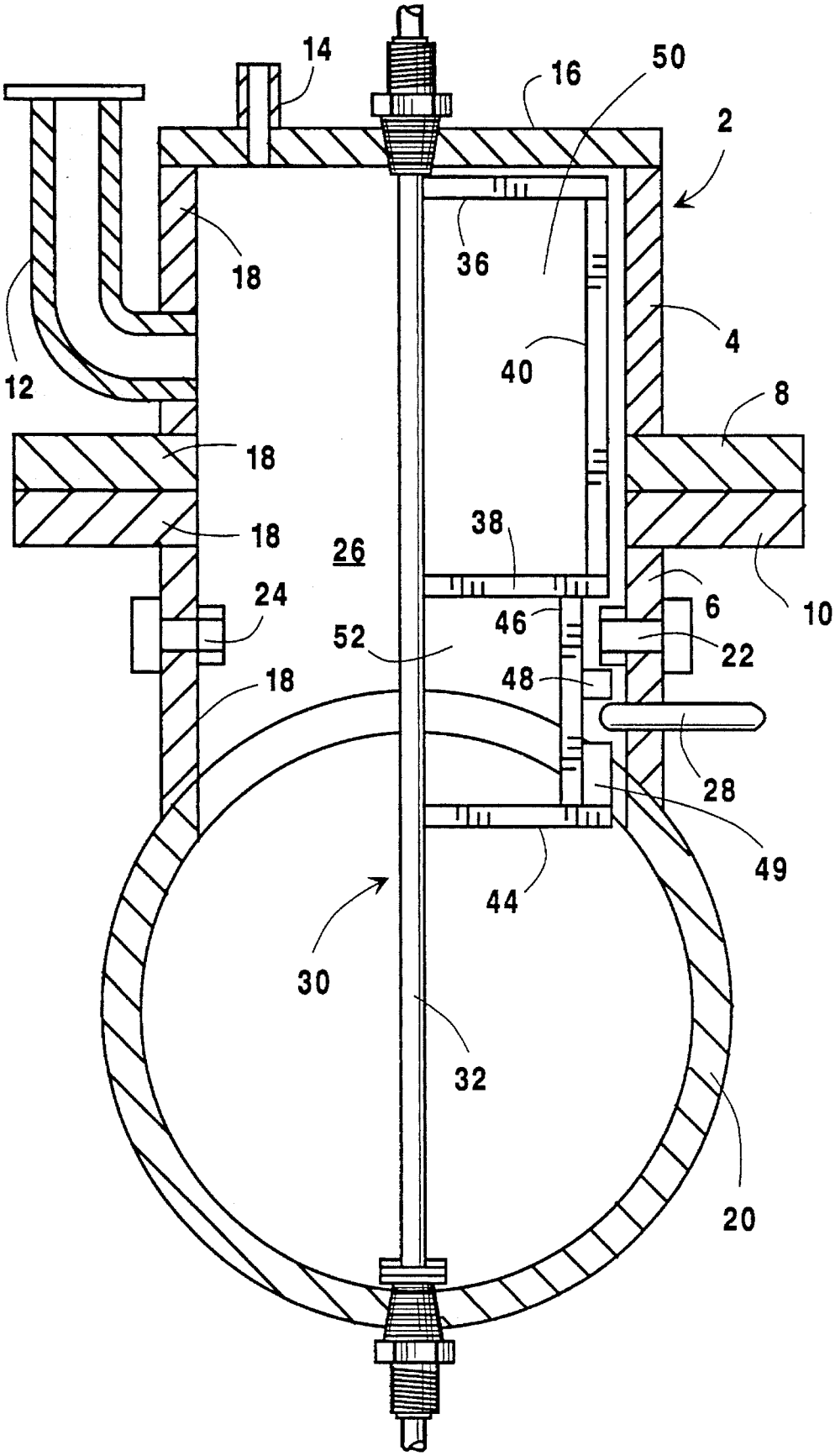
14
16
50
2
18
36
4
12
40
8
18
18
38
26
24
6
10
46
52
22
18
48
28
49
44
30
32
20

MECHANICAL WIPER FOR WASTE GAS INCINERATOR

FIELD OF THE INVENTION

The invention relates to the use of a mechanical wiper to remove buildup of combustion products on the wall of a waste gas incinerator in which the wiper is made from or coated with a corrosive and wear resistant material.

BACKGROUND OF THE INVENTION

It is well known that waste gases such as highly toxic, pyrophoric and flammable waste gases can be safely disposed of by burning the gases in a controlled combustion incinerator. A combustion incinerator for burning such gases is available commercially under the trademark GUARDIAN, which trademark is owned by Hoechst A. G. During the combustion of waste gases, combustion products are formed that could adhere to the walls of the combustion chamber. Generally, the combustion chamber is equipped with a thermocouple and at least one ignitor port. Heavy deposits of combustion products on the thermocouple could result in insulating the thermocouple from the heat of the reaction chamber and possibly cause a spurious low temperature reading. This false reading could activate a safety alarm and result in a needless maintenance check on the system. The buildup of combustion products on the ignitor ports could result in a restriction of the flow of the combustion fuel into the chamber to maintain a safe operating temperature in the reaction zone. It is also possible that the fuel supply from the ignitor port could be completely blocked and thus cause an actual stoppage of the combustion in the chamber. Without a permanent flame and flow of fuel in the combustion chamber, flammables and pyrophorics may not be completely converted to nonflammable materials. It is well known that when the waste gas is silane, dilution of the silane will not necessarily prevent silane fires and explosions.

A solution to the problem of combustion product buildup is to use pulsed blasts of high pressure clean dry air against the side wall of the combustion chamber and the face of the thermocouple. When the waste gas is silane-based gases or dichlorosilane gases, the combustion incinerator burns large quantities of these waste gases, frequently at high gas flow rates such as from 3 to 6 standard cubic feet per minute. Most of the solid combustion product (almost entirely silicon dioxide or silica) is entrained with the large air flow through the incinerator and is carried downstream where it is collected. However, during high flowrate burns, solid combustion product builds up rapidly on the wall of the combustion's reaction chamber. Under these conditions, experience showed that the pulse blast air system did not clean the reaction chamber nearly well enough to permit safe, unattended operation of the incinerator.

A conventional incinerator has a duct of circular cross section through which combustion air is drawn by the fan of a downstream scrubber or baghouse (filter). The integral reaction chamber, also with a circular cross section is centered closest to the air-inlet end of the duct and perpendicular to the axis of the duct. Waste gases are introduced into the incinerator by a number of high pressure and/or low pressure pipes attached to the chamber. At two locations 90 degrees apart, there are ignitors inserted into ports in the reaction chamber wall. A fuel, preferably hydrogen and clean dry air (CDA) are supplied to each ignitor and are mixed therein. Each ignitor is fitted with a continuously firing spark plug which ignites the fuel-air mixture creating a horizontal flame front in the reaction chamber. Incoming waste gases pass through the flame front where they are ignited and burn in a shearing flow created at the lower end of the reaction chamber where the downwardly flowing gases meet with a perpendicular air flow. The air drawn into the duct is much in excess of that needed for stoichiometric combustion of the waste gases. The excess air cools the combustion products before they leave the exhaust end of the duct. Air drawn into the duct is set to have a flow velocity at least three times greater than the flame velocity of hydrogen which is the fastest burning gas. This is intended to prevent flame exit from the air-inlet end of the duct.

An electronic controller could be used to monitor a number of the operational variables of the incinerator, such as fuel pressure, temperatures, air flow velocity, ignitor power, and line voltage. The controller provides audible and visual warnings. It also provides control signals for interconnection with other waste product disposal system equipment. The reaction chamber and exhaust gas temperatures could be monitored by the controller by means of a thermocouple inserted into the reaction chamber and into the exhaust end of the incinerator's duct. There are preset limits, upper and lower, on the reaction chamber temperature, and there are upper limits imposed on the exhaust gas temperature because of other process equipment downstream. For safe operation of the incinerator, the reaction chamber temperature is normally between 350° C. and 1150° C. Exhaust gas temperature is usually limited to 200° C. but may be as high as 400° C. depending on the downstream equipment and the flowrate at which waste gases are burned in the reaction chamber.

As stated above, it was found that occasionally the pulsed blast of high pressure clean dry air did not clean the reaction chamber satisfactorily during periods of high waste gas burn rates of 3 to 6 standard cubic feet per minute. This resulted in too much buildup of combustion products remaining on the thermocouple, reaction chamber walls, and on the ignitor ports even after the pulsed blast of high pressure clean dry air was used.

It is an object of the present invention to provide a mechanical wiper means for effectively and efficiently removing combustion product buildup from the inner wall of a waste gas incinerator.

It is another object of the present invention to provide a mechanical wiper means for removing combustion product buildup from the ignitor ports and a thermocouple projected from the inner wall of a waste gas incinerator.

It is another object of the present invention to provide a cost effective means for removing combustion product buildup on the wall of a waste gas incinerator.

SUMMARY OF THE INVENTION

The invention relates to a waste gas incinerator comprising a combustion chamber having an inner wall; means for injecting a combustible fuel into the chamber; means for injecting a waste gas into the chamber to be burned; ignitor means for igniting the combustible fuel; and a mechanical wiper disposed within the chamber and adapted to move adjacent to at least a substantial portion of the inner wall so that buildup of products of combustion or reaction adhering to the wall can be mechanically removed by the wiper.

As used herein, waste gas shall be any gas or gas-containing fluid that is to be burnt or reacted within the incinerator. As also used herein, combustion fuel shall mean a fuel in combination with an oxygen-containing gas (i.e. oxygen, air, etc.), if required, for combustion of the fuel.

Waste gas silane incinerators are used for such gases as silane; silane mixtures with phosphine, argon, hydrogen, nitrogen or helium; diborane (usually at 5 ppm to 1%) mixtures with argon, hydrogen, nitrogen or helium; diborane-silane trimixes with argon, hydrogen, nitrogen or helium; phosphine-silane trimixes with argon, hydrogen, nitrogen or helium; and hydrogen coincinerant. Waste gas dichlorosilane incinerators are used for such gases as dichlorosilane; diethyltelluride-hydrogen mixtures (diethyltelluride usually as 5 to 100 ppm); and hydrogen coincinerant. Since these incinerators for waste gases are made to operate at temperatures from 350° C. to 1150° C., the exterior surface of the wiper has to be resistant to the higher temperature range and also corrosive resistant to the environment produced by the burning of the waste gas. Thus the wiper could be made of a homogeneous material such as (Trademark Haynes Alloy No. 556) (20% nickel, 18% cobalt, 22% chromium, 3.0% molybdenum, 2.5% tungsten, 0.6% tantalum, 0.2% nitrogen, 0.4% silicon, 1.0% manganese, 0.2% aluminum, 0.10% carbon, 0.02% lanthanum, 0.02% zirconium, and balance iron (Trademark Haynes Alloy No. 556; composition 20% nickel, 20% cobalt, 30% iron as balance, 21% chromium, 3% molybdenum, 25% tungsten, 1.5% manganese, 1% silicon max., 0.12% carbon, 1% columbium plus tantalum and 0.15% nitrogen (Trademark Multimen Alloy R30155) alloy; and composition 47% nickel as balance, 1.5% cobalt, 18% iron, 22% chromium, 9% molybdenum, 0.6% tungsten, 1% silicon max., 0.1% carbon and 0.008% boron max (Trademark Hastelloy X Alloy No 6002). It is believed that the lanthanum component in the Haymes Alloy No. 556 provides some of the corrosion resistance of the coating. The wiper could also be made of any substrate material such as alloy compositions. (72% min nickel plus cobalt, 14–17% chromium, 6–10% iron, 0.15% maximum carbon, 1.0% maximum manganese, 0.015% maximum sulfur, 0.50% maximum silicon, and 0.50% maximum copper (Trademark Inconel 600 Alloy) coated with a substantially impervious corrosion resistant coating such as a nickel-cobalt-chromium based alloy, carbide, metal carbide, ceramics or the like. When the combustion chamber is tubular, the wiper could be mounted on an axially aligned and rotatable support member. In this embodiment, the preferred structure will be to have the wiper blade composed of an elongated tube or rod secured to the rotatable support member by horizontal tubes or rods. In this embodiment, the wiper components will comprise a minimum surface area so as to minimize any combustion product buildup on the wiper components. Although less desirable, the wiper could comprise a radially extended solid blade type structure that would be secured to a longitudinal and rotatable support rod at the enter of the chamber. In this embodiment, the surface area of the wiper would be much greater and thereby provide a large area for undesirably receiving any deposited combustion product buildup. In addition, the blade type wiper could interface with the combustion of the waste gases as it revolves about the longitudinal axis of the chamber.

Another embodiment of the wiper could be a circular loop disposed adjacent the inner upstanding sidewall of the chamber that could be reciprocated up and down at preselected intervals to mechanically dislodge any buildup of combustion products on the inner upstanding wall. In the normal operation of this embodiment, the loop would be maintained at the bottom of the chamber where the temperature is relatively lower than the reaction zone of the chamber and thus the wiper would not be constantly subjected to the higher temperature and corrosiveness in the reaction zone.

In a conventional combustion chamber, the ignitor ports would project from the inner wall of the chamber and allow the combustible fuel to be fed into the chamber. Associated with the ignitor ports would be means to ignite the combustible fuel such as a spark plug or the like. Also projected from the inner wall of the combustion chamber could be a thermocouple to monitor the temperature of the reaction zone within the chamber. The wiper of this invention could be designed to pass adjacent the projected ignitor ports and thermocouple so as to remove buildup of combustion products thereon.

In an ideal embodiment, the wiper would be designed to ride on the inner wall of the chamber and on the surface of the protruded ignitor ports and thermocouple. However, due to thermal expansion, the wiper is designed to be spaced from the inner wall and protruding components by an amount at least equal to the radial expansion of the wiper when it is exposed to the high temperature environment of the reaction zone. This will insure that upon the radial expansion of the wiper, the wiper will not be forced against the inner upstanding wall and rub thereon. This could cause frictional wear of the wiper especially during high temperature operation of the incinerator. Generally, the wiper for a 6-inch internal diameter combustion chamber could be spaced from the inner wall of the chamber and the projected components by 1/8 to 1/16 inch, preferably 1/16 to 1/32 inch when at operational temperature. An essential feature of the wiper is that as it moves adjacent to the upstanding wall of the chamber and the projected components, it will remove buildup of combustion products deposited on the these internal areas. Another essential feature is that at least the surface material of the wiper be corrosion resistant to the environment that will be produced by the burning of a particular waste gas and also heat resistant to the temperature at which the incinerator will operate. For most applications a superalloy would be suitable for the material of the wiper such as Haynes Alloy No. 556, Multinet Alloy, Hatelloy X Alloy, nickel-cobalt-chromium based alloys or the like. Also the wiper could be made of any suitable substrate material and then coated with a ceramic, carbide, metal carbide or nickel-cobalt-chromium based alloy that has the required corrosion resistant and heat resistant characteristics.

The invention also relates to a method of burning waste gases comprising the steps:

(a) feeding into a reaction zone of an enclosed incinerator having an inner upstanding wall a combustible fuel and at least one waste gas and then igniting said combustible fuel to burn said waste gas;

(b) removing the burnt gas from the incinerator; and (c) wiping the area adjacent at least a portion of the upstanding wall of the incinerator with an internally secured moveable wiper so as to remove buildup of combustion products adhering to the upstanding wall.

In an incinerator having components such as ignitor ports and thermocouples projected from the inner upstanding wall, then in step (c) the wiper will wipe the area adjacent the outer surface of said components to remove buildup of combustion products adhering to said components.

In comparison with the pulse air blast cleaning, some benefits of the subject invention are:

1. Cleaning is effective when most needed, especially during high waste-gas burn rates.

2. There are no air-blast orifices or slits that can become plugged; therefore, cleaning is consistent and uniform.

3. The wiper does not affect burning and never extinguishes the ignitor flames.
4. The wiper cannot cause a backflow of flaming waste gas and/or combustion products out of the waste gas inlet.
5. Because the cleaning is continuous, the wiper prevents large solid buildup; therefore, no large glowing embers are dislodged into the incinerator's exhaust flow.
6. Solid buildup on the reaction chamber thermocouple is maintained at a uniform minimum so that erroneously low reaction chamber temperature indications are prevented or can be accounted for. This precludes unnecessary and unsafe shutdowns of the incinerator.

The mechanical wiper of this invention is suitable for all types of waste gas incinerators, particularly waste gas incinerators employing a cylindrical combustible gas chamber equipped with at least one ignitor ports and at least one thermocouple. The time cycle for the wiper to move across the upstanding wall of the combustion chamber will depend on the particular gas being burnt and the rate of buildup of the combustion products on the upstanding wall. For most applications, a longitudinal wiper could be rotated at about 2.5 revolutions per minute to effectively and efficiently remove unwanted combustion products buildup on the upstanding wall and any other component projecting from the upstanding wall. For the circular loop configuration embodiment of the wiper, it could be moved up and down at a rate of 1 to 1.5 cycles per minutes for most applications.

BRIEF DESCRIPTION OF THE DRAWINGS

The sole drawing is a cross-sectional view of a waste gas incinerator employing a rotatable wiper disposed adjacent the upstanding wall of the reaction chamber of the incinerator.

The drawing shows a combustion chamber 2 composed of an upper chamber segment 4 having a flange 8 and lower chamber segment 6 having a flange 10. The upper chamber 4 is secured to the lower chamber 6 using flanges 8 and 10 which are secured together using conventional bolt and nut means which are not shown. In the upper chamber 4, a low pressure waste-gas inlet pipe 12 is shown which usually contains waste gas from a purge line or the like. A high pressure waste-gas inlet pipe 14 is shown disposed in the top cap 16 of the chamber 4 for injecting waste gas, usually from a pressurized line. Although only one low pressure waste gas line and one high pressure waste gas line are shown, in many applications, a plurality of low pressure waste gas lines and/or high pressure waste gas lines would be employed. Combustion chamber 2 comprises upstanding wall 18 composed of the inner wall of upper chamber 4, inner wall of flanges 8 and 10 and the inner wall of lower chamber 6, and said wall being closed at the top with cap 16. The bottom of chamber 2 is disposed over and closes an elongated duct 20 which receives the burnt waste gases and ejects them out through one end of duct 20. Disposed in the upstanding wall 18 of the lower chamber 6 are two ignitor ports 22 and 24. Combustion fuel, such as hydrogen, natural gas, propane and the like, and air is fed through the ports 22 and 24 into the reaction zone 26 of chamber 2. Associated with ignitor ports 22 and 24 are ignitor means such as a spark plug or the like which is not shown. A thermocouple 28 is shown disposed in upstanding wall 18 of lower chamber 6 and functions to monitor the temperature in the reaction zone 26. In the operational mode, waste gases are fed through inlet pipe 12 and/or inlet pipe 14 while combustible fuel is fed through ignitor ports 22 and 24. The combustible fuel is ignited, thereby burning the waste gases which are then removed through duct 20 by means such as air flowing through the duct (not shown). During the burning of the combustible gases, combustion products are formed that adhere to the inner upstanding wall 18 of chamber 2 and also to the projected portion of thermocouple 28 and ignitor ports 22 and 24. If the combustion products are not removed, the ignitor ports 22 and 24 could be blocked, thus feeding insufficient combustible fuel into the reaction zone 26, and the thermocouple could be insulated from the heat in the reaction zone 26 thus displaying an incorrect temperature. To remove the unwanted buildup of combustible products in accordance with this invention, a rotatable wiper assembly 30 is assembled within chamber 2. Specifically, a rotatable rod 32 axially aligned within chamber 2 and secured at one end to cap 16 and at the opposite end to the bottom of duct 20 using conventional securing means. Rod 32 is rotated by conventional means such as an electric motor or the like which is not shown. Radial rod 36 is secured to one end of rod 32 and radial rod 38 is secured to rod 32 a fixed space below the securement of radial rod 36. Wiper rod 40 is secured between rods 36 and 38 and is spaced from the internal upstanding wall 18 of chamber 2 by a distance of at least the amount the assembly 30 will radially expand when exposed to the high temperature of the reaction zone during operation of the incinerator. Radial rod 44 is secured to rod 32 below radial rod 38 and a vertical wiper rod 46 is secured to rods 38 and 40. As shown, wiper rod 46 is spaced adjacent ignitors 22 and 24 and thermocouple 28. Between ignitor 22 and thermocouple 28 on wiper rod 46 is an extender wiper segment 48 which is spaced adjacent a segment of upstanding wall 18. Extender wiper segment 49 on wiper rod 46 is spaced adjacent to a segment of upstanding wall 18 below thermocouple 28 to complete coverage of wall 18. Opening 50 defined by rods 32, 36, 38 and 42, and opening 52 defined by rods 32, 38, 46 and 44 provide the wiper assembly 30 with a minimum of parts so that any buildup of combustion products on the assembly 30 is maintained at a minimum. In the operational mode, the wiper assembly 30 is rotated, preferably at a constant rate such as about 2.5 rpm, during the burning operation of the incinerator. The wiper rod 40 moves over an area adjacent upstanding wall 18 to remove combustion products adhering thereto, wiper rod 36 moves over an area adjacent cap 16 to remove combustion products adhering thereon, and wiper rod 46 with segments 48 and 49 moves over an area adjacent ignitor ports 22 and 24 and thermocouple 28 to remove combustion products adhering thereto. Thus the mechanical moveable wiper of this invention, that is mounted within the incinerator, can be constantly moved over the selected internal areas of the incinerator where combustion products have an affinity to be deposited.

It is to be understood that modifications and changes to the preferred embodiment of the invention herein described can be made without departing from the spirit and scope of the invention. For example, the rotatable rod 32 could have one support rod 36 which could support a vertical wiper rod similar to wiper rod 40 so that support rod 36 and rod 40 would be the wiper elements of the wiper assembly. In another embodiment the segment of the rotatable rod 32 between rod 36 and rod 44 could be eliminated and the wiper rod 40 could still function as intended. Although the combustion chamber is shown vertical, it may be orientated in any position such that the air duct could be vertical and the combustion chamber could be horizontal.

What is claimed:

1. A waste gas incinerator comprising a combustion chamber having an inner wall; first means for injecting a combustible fuel into the chamber; second means for injecting at least one waste gas into the chamber to be burned; ignitor means for igniting the combustible fuel; and a mechanical wiper disposed within the chamber and adapted to move adjacent at least a portion of the inner wall so that buildup of products of combustion or reaction adhering to the inner wall will be mechanically removed by the wiper and wherein the first means comprises at least one ignitor port at least partially protruded from the inner wall of the chamber and the mechanical wiper is adapted to move adjacent the protruded ignitor port so that buildup of products of combustion or reaction adhering to the protruded ignitor port can be mechanically removed by the wiper.

2. The waste gas incinerator of claim 1 wherein the combustion chamber has a cap with an inner surface disposed over the wall and the mechanical wiper is adapted to move adjacent the inner surface of the cap so that buildup of products of combustion or reaction adhering to the inner surface can be mechanically removed by the wiper.

3. The waste gas incinerator of claim 1 wherein a thermocouple is at least partially protruded from the inner wall of the chamber and the mechanical wiper is adapted to move adjacent the protruded thermocouple so that buildup of products of combustion or reaction adhering to the protruded thermocouple can be mechanically removed by the wiper.

4. The waste gas incinerator of claim 1 wherein the mechanical wiper is made of a nickel-cobalt-chromium base alloy.

5. A waste gas incinerator comprising a combustion chamber having an inner wall; first means for injecting a combustible fuel into the chamber; second means for injecting at least one waste gas into the chamber to be burned; ignitor means for igniting the combustible fuel; and a mechanical wiper disposed within the chamber and adapted to move adjacent at least a portion of the inner wall so that buildup of products of combustion or reaction adhering to the inner wall will be mechanically removed by the wiper and wherein the chamber is a cylindrical chamber having an inner upstanding wall and the mechanical wiper comprises a rotatable rod axially mounted within said chamber and having at least one support rod radially extended from the rotatable rod and secured at the end of the support rod is a wiper rod aligned parallel to the longitudinal axis of the chamber and disposed adjacent the inner upstanding wall of the chamber.

6. The waste gas incinerator of claim 5 wherein said rotatable rod has two spaced apart support rods radially extended from the rotatable rod and a wiper rod is secured to the ends of the radially extended rods and disposed adjacent the inner upstanding wall of the chamber.

7. The waste gas incinerator of claim 5 wherein the first means comprises at least one ignitor port at least partially protruded from the inner upstanding wall of the chamber and the mechanical wiper is adapted to move adjacent the protruded ignitor port so that buildup of products of combustion or reaction adhering to the protruded ignitor port can be mechanically removed by the wiper.

8. The waste gas incinerator of claim 7 wherein a thermocouple is at least partially protruded from the inner upstanding wall of the chamber and the mechanical wiper is adapted to move adjacent the protruded thermocouple so that buildup of products of combustion or reaction adhering to the protruded thermocouple can be mechanically removed by the wiper.

9. The waste gas incinerator of claim 8 wherein the mechanical wiper is made of a nickel-cobalt-chromium base alloy.

10. A method of burning waste gases comprising the steps:

(a) feeding into a reaction zone of an enclosed incinerator having an inner wall with at least one protruded ignitor port and at least one protruded thermocouple, a combustible fuel and an oxygen-containing component, and at least one waste gas and then igniting said combustible fuel to burn said waste gas;

(b) removing the burnt gas from the incinerator; and (c) wiping an area adjacent at least a portion of the inner wall of the incinerator containing the protruded ignitor port and protruded thermocouple with a moveable internally secured wiper so as to remove buildup of combustion or reaction products adhering to the upstanding wall.

11. The method of claim 10 wherein the waste gas is at least one gas selected from the group consisting of silane; silane mixtures with phosphine, argon, hydrogen, nitrogen or helium; diborane mixtures with argon, hydrogen, nitrogen or helium; diborane-silane trimixes with argon, hydrogen, nitrogen or helium; phosphine-silane trimixes with argon, hydrogen, nitrogen or helium; hydrogen coincinerant; dichlorosilane; and diethyltelluride-hydrogen.

12. The method of claim 11 wherein the combustible fuel is selected from the group consisting of hydrogen, natural gas and propane.

13. A method of burning waste gases comprising the steps:

(a) feeding into a reaction zone of an enclosed incinerator having an inner wall a combustible fuel and an oxygen-containing component, and at least one waste gas and then igniting said combustible fuel to burn said waste gas;

(b) removing the burnt gas from the incinerator; and (c) wiping at a constant rate an area adjacent at least a portion of the inner wall of the incinerator with a moveable internally secured wiper so as to remove buildup of combustion or reaction products adhering to the upstanding wall.

14. The method of claim 13 wherein in step (a) the incinerator comprises a cylindrical structure with an upstanding wall and in step (c) the internally moveable wiper is disposed adjacent to the upstanding wall and parallel to the longitudinal axis of the cylindrical structure so that said wiper rotates around the longitudinal axis of the cylindrical structure.

15. The method of claim 14 wherein the wiper is rotated at a rate of 2.5 revolutions per minute.

* * * * *